US006243547B1

(12) United States Patent
Mizuno et al.

(10) Patent No.: US 6,243,547 B1
(45) Date of Patent: Jun. 5, 2001

(54) IMAGE HEATING APPARATUS HAVING A PLURALITY OF HEATERS

(75) Inventors: Yoshio Mizuno, Ichikawa; Toshihiko Kitahara, Tokyo, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/459,858

(22) Filed: Dec. 14, 1999

(30) Foreign Application Priority Data

Dec. 18, 1998 (JP) ..... 10-361506

(51) Int. Cl.[7] ..... G03G 15/00; G03G 15/20

(52) U.S. Cl. ..... 399/69; 219/216; 219/470; 219/494; 399/33

(58) Field of Search ..... 399/69, 70, 67, 399/330, 335, 33; 219/216, 255, 469, 470, 490, 494; 118/60; 347/156

(56) References Cited

U.S. PATENT DOCUMENTS

| | | | | |
|---|---|---|---|---|
| 4,977,431 | * | 12/1990 | Fuji | 399/69 |
| 4,998,121 | | 3/1991 | Koh et al. | 347/156 |
| 5,708,920 | * | 1/1998 | Ohnishi et al. | 399/69 |
| 5,724,628 | * | 3/1998 | Sano | 399/33 |
| 5,904,871 | * | 5/1999 | Sakai et al. | 219/216 |
| 5,994,671 | * | 11/1999 | Suzuki et al. | 219/216 |

* cited by examiner

*Primary Examiner*—Sophia S. Chen
(74) *Attorney, Agent, or Firm*—Fitzpatrick, Cella, Harper & Scinto

(57) ABSTRACT

An image heating apparatus is provided where an electrical power supply to a second heater is started during the electrical power supply to a first heater, a power supply control that controls the electrical power supply to the first heater in accordance with a condition of the second heater.

9 Claims, 6 Drawing Sheets

IMAGE HEATING APPARATUS HAVING A PLURALITY OF HEATERS

BACKGROUND OF THE INVENTION

1. Field of the Invention

The present invention relates to an image heating apparatus for use in image forming apparatuses such as a copying machine and a printer, particularly to an image heating apparatus having a plurality of heaters.

2. Related Background Art

In an image forming apparatus using an electrophotographic system, during image formation, the surface of an electrophotographic photosensitive member is uniformly charged by a charge apparatus, the surface of the charged electrophotographic photosensitive member is exposed to light by an exposure apparatus, and an electrostatic latent image is formed. Subsequently, this electrostatic latent image is developed by a developing apparatus to form a toner image, this toner image is transferred to transfer materials such as a sheet by a transfer apparatus, and the toner image is fixed as a permanent fixed image on the transfer material by a fixing apparatus, and outputted.

In the fixing apparatus, the transfer material with the unfixed toner image transferred thereon is pinched and conveyed in a fixing nip portion between a fixing roller and a pressurizing roller, and the unfixed toner image is heated by a heater as a heating material disposed in the fixing roller, so that the unfixed toner image can be fixed as the permanent fixed image on the transfer material.

In the fixing apparatus, the temperature of the fixing roller is usually detected by temperature detecting elements such as a thermistor, and the electrical power supply to an inner heater is controlled so that the detected temperature of the temperature detecting element is maintained at a set temperature suitable for fixing a toner. By this temperature control, the fixing roller can be maintained at the set temperature even if heat is taken by paper during fixing.

Additionally, as one example of the fixing apparatus, two heaters (halogen heaters) of a main heater and a sub-heater are disposed in the fixing roller.

During the fixing, control is performed in order to constantly light the main heater and light the sub-heater only when the detected temperature of the temperature detecting element is lower than the set temperature, so that a temperature drop can be suppressed with a small power consumption even during continuous printing.

Additionally, in the conventional temperature control to the above-described heaters (main heater and sub-heater), when only the main heater is in a driven state, and the sub-heater starts to be driven, then the non-driven sub-heater is in a cool state.

Therefore, when the total of currents of a large rush current value flowing at a timing when the sub-heater is driven and a current value flowing through the main heater increases, a fluctuation of an input voltage of an alternating-current power source itself for supplying an electrical power to the heaters (main heater and sub-heater) increases, thereby causing a problem that a flicker increases.

SUMMARY OF THE INVENTION

The present invention has been developed in consideration of the above-described problems, and an object thereof is to provide an image heating apparatus which can suppress a flicker.

Another object of the present invention is to provide an image heating apparatus which can suppress a rush current.

Still another object of the present invention is to provide an image heating apparatus comprising:

a first heater;

a second heater; and power supply control means for controlling an electrical power supplied to the first and second heaters, wherein when the electrical power supply to the second heater is started during the electrical power supply to the first heater, the power supply control means controls the electrical power supply to the first heater in accordance with a condition of the second heater.

Still further object of the present invention is to provide an image heating apparatus comprising:

a first heater;

a second heater; and power supply control means for controlling an electrical power supplied to the first and second heaters, wherein when the electrical power supply to the second heater is started during the electrical power supply to the first heater, the power supply control means temporarily discontinues the electrical power supply to the first heater and simultaneously starts the electrical power supply to the second heater, and subsequently restarts the electrical power supply to the first heater.

Further objects of the present invention will be apparent upon reading the following detailed description with reference to the accompanying drawings

DETAILED DESCRIPTION OF THE PREFERRED EMBODIMENTS

An embodiment of the present invention will be described hereinafter with reference to the drawings.

Figure 1:
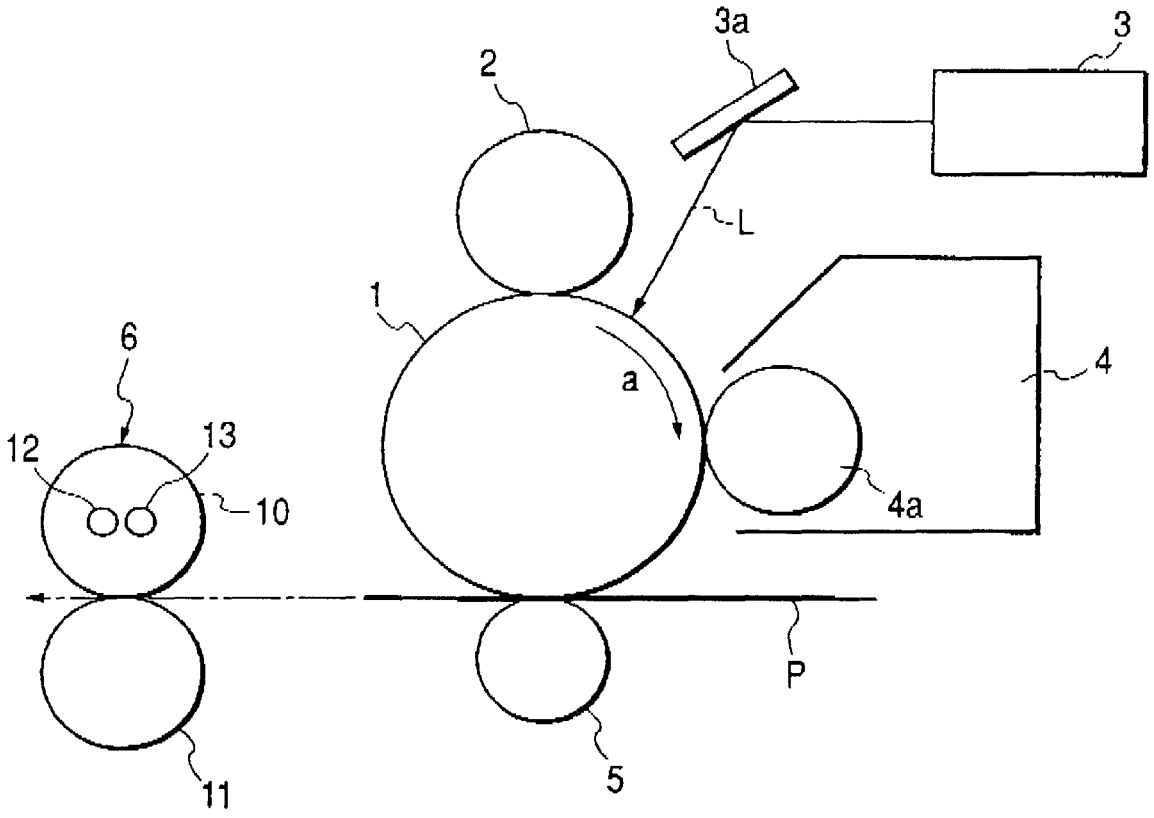
FIG. 1 is a schematic view showing an image forming apparatus of the present invention.

FIG. 1 is a schematic view showing an image forming apparatus (a copying machine of an electrophotographic system in the present embodiment) according to the present embodiment.

In FIG. 1, there are provided a rotary drum type electrophotographic photosensitive member 1 (hereinafter referred to as the photosensitive member) as an image bearer (image bearing member), a charging roller 2, an exposure apparatus 3, a developing apparatus 4, a transfer roller 5, and a fixing apparatus 6.

The photosensitive member 1 is an organic negatively charged photosensitive member in the present embodiment, and comprises a photosensitive layer (not shown) on a drum base member of aluminum (not shown). The member is rotated/driven in a direction of arrow a at a predetermined process speed, and subjected to a uniform charge processing with a negative polarity by the charging roller 2 in the rotation process.

The charging roller 2 is placed in contact with the surface of the photosensitive member 1 with a predetermined pressing force, and driven to rotate with the rotation drive of the photosensitive member 1. By applying a predetermined charge bias to the charging roller 2 from a charge bias power source (not shown), the photosensitive member 1 is charge-processed to provide predetermined polarity and potential.

For the exposure apparatus 3, the exposure by laser beams or LED beams L is performed on the charge-processed photosensitive member 1 via a reflective mirror 3*a* in accordance with inputted image information to form an electrostatic latent image.

The developing apparatus 4 is a reversal developing apparatus having a developing sleeve 4*a*, and a predetermined developing bias is applied to the developing sleeve 4*a* from a developing bias power source (not shown). Thereby, the toner with a negative polarity adheres to the portion exposed by the exposure apparatus.

The transfer roller 5 is placed in contact with the surface of the photosensitive member 1 with a predetermined pressing force, driven to rotate with the rotation drive of the photosensitive member 1, and provided with a predetermined transfer bias applied from a transfer bias power source (not shown).

The fixing apparatus 6 comprises a rotatably supported drum-shaped fixing roller 10 and a pressurizing roller 11, and a main heater 12 and a sub-heater 13 are disposed in the fixing roller 10 (the fixing apparatus 6 will be described later in detail).

The image forming operation of the above-described image forming apparatus will next be described.

During image formation, the photosensitive member 1 is rotated/driven in the direction of arrow a at the predetermined process speed by drive means (not shown), and subjected to the uniform charge processing with the negative polarity by the charging roller 2 with the charge bias applied thereto.

Subsequently, the exposure by laser beams or LED beams is applied to the surface of the charge-processed photosensitive member 1 via the reflective mirror 3*a* from the exposure apparatus 3, and the electrostatic latent image is formed in accordance with the inputted image information. Subsequently, the electrostatic latent image is developed by the developing sleeve 4*a* with the developing bias applied thereto, and visualized as the toner image.

When the toner image on the surface of the photosensitive member 1 reaches the transfer nip portion between the transfer roller 5 and the photosensitive member 1, a transfer material P is conveyed to this transfer nip portion at this timing, and the toner image is transferred by the transfer roller 5 with the transfer bias applied thereto. The transfer material P with the toner image transferred thereto is conveyed to the fixing apparatus 6 After the unfixed toner image is heated/pressurized and fixed onto the transfer material P in the fixing nip portion between the fixing roller 10 and the pressurizing roller 11, the transfer material is discharged to the outside.

The detailed constitution and the fixing operation of the fixing apparatus 6 according to the present invention will next be described.

Figure 2:
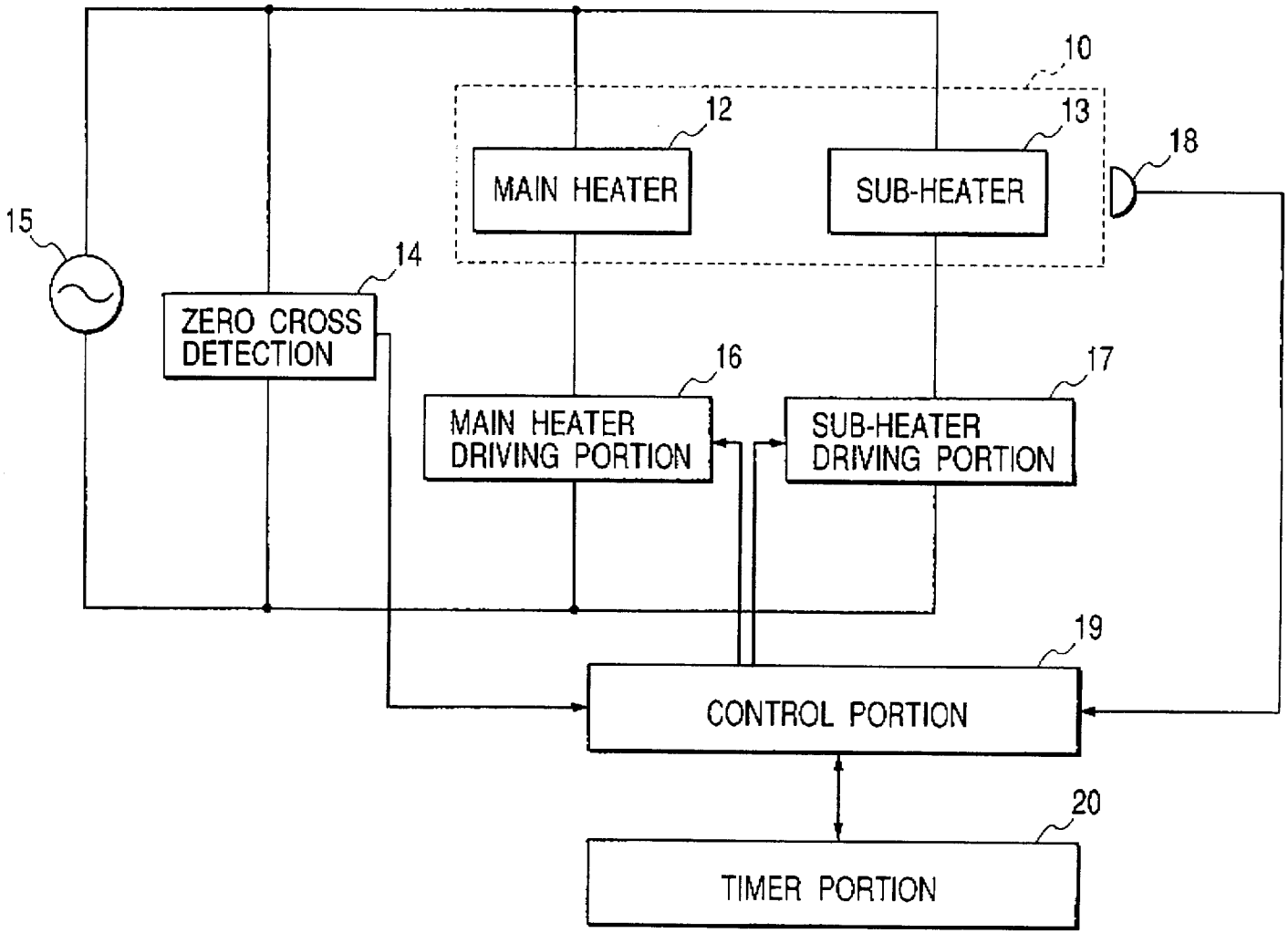
FIG. 2 is a block diagram showing a temperature control system of a fixing apparatus of the image forming apparatus according to the present invention.

FIG. 2 is a block diagram showing the temperature control system of the fixing apparatus 6.

In FIG. 2, a zero cross detecting portion 14 detects a timing as the zero voltage of an alternating-current power source 15. A thermistor 18 detects a surface temperature of the fixing roller 10 as a fixing portion. In the present embodiment, while the thermistor 18 and a resistor are connected in series, the thermistor is placed in contact with the surface of the fixing roller 10. By connecting the voltage of the thermistor 18 to an A/D conversion input port of a control portion 19 to detect the voltage of the thermistor every given time (constant time), the surface temperature information of the fixing roller 10 can be detected by the voltage. Thereby, the surface temperature of the fixing roller 10 is detected, and the fixing temperature is controlled by supplying an electrical power to two heaters of the main heater 12 and sub-heater 13 (both are constituted of the same halogen heater with the same heating distribution) disposed in the fixing roller 10 from the alternating-current power source 15 so that the detected temperature is maintained at the set temperature.

A main heater driving portion 16 and a sub-heater driving portion 17 drive the main heater 12 and the sub-heater 13, respectively. In the present embodiment, the signal from the zero cross detecting portion 14 is inputted to the control portion 19, and used as the control signal timing of the main heater driving portion 16 and the sub-heater driving portion 17 for zero cross control, but also by using SSR as a drive element with a zero cross function, the effect similar to that of the zero cross control can be obtained.

Therefore, by driving the main heater driving portion 16 and the sub-heater driving portion 17 with the control signal from the control portion 19, the main heater 12 and the sub-heater 13 can fully be energized by the zero cross control.

Moreover, a timer portion 20 measures time when the main heater driving portion 16 and the sub-heater driving portion 17 drive the main heater 12 and the sub-heater 13.

The temperature control system of the fixing apparatus 6 according to the present embodiment is constituted as described above. In the conventional temperature control, since the temperature of the fixing roller 10 is secured only by the sub-heater 13, for example, at the time of standby by a copying mode, a flicker noise value is not raised very much. However, since the fixing temperature needs to be secured by driving both the main heater 12 and the sub-heater 13 during the continuous copy mode as described above, the rush current flows at the drive timing of the sub-heater 13, and this influences and raises the flicker noise value.

As described above, in the conventional temperature control, when the thermistor 18 detects that the fixing temperature is lowered, and the sub-heater 13 is energized to raise the fixing temperature to the predetermined temperature, the temperature of the sub-heater 13 itself lowers. Therefore, by the influence of the flowing rush current, a drop of input voltage is generated and the flicker noise value is raised.

Figure 3:
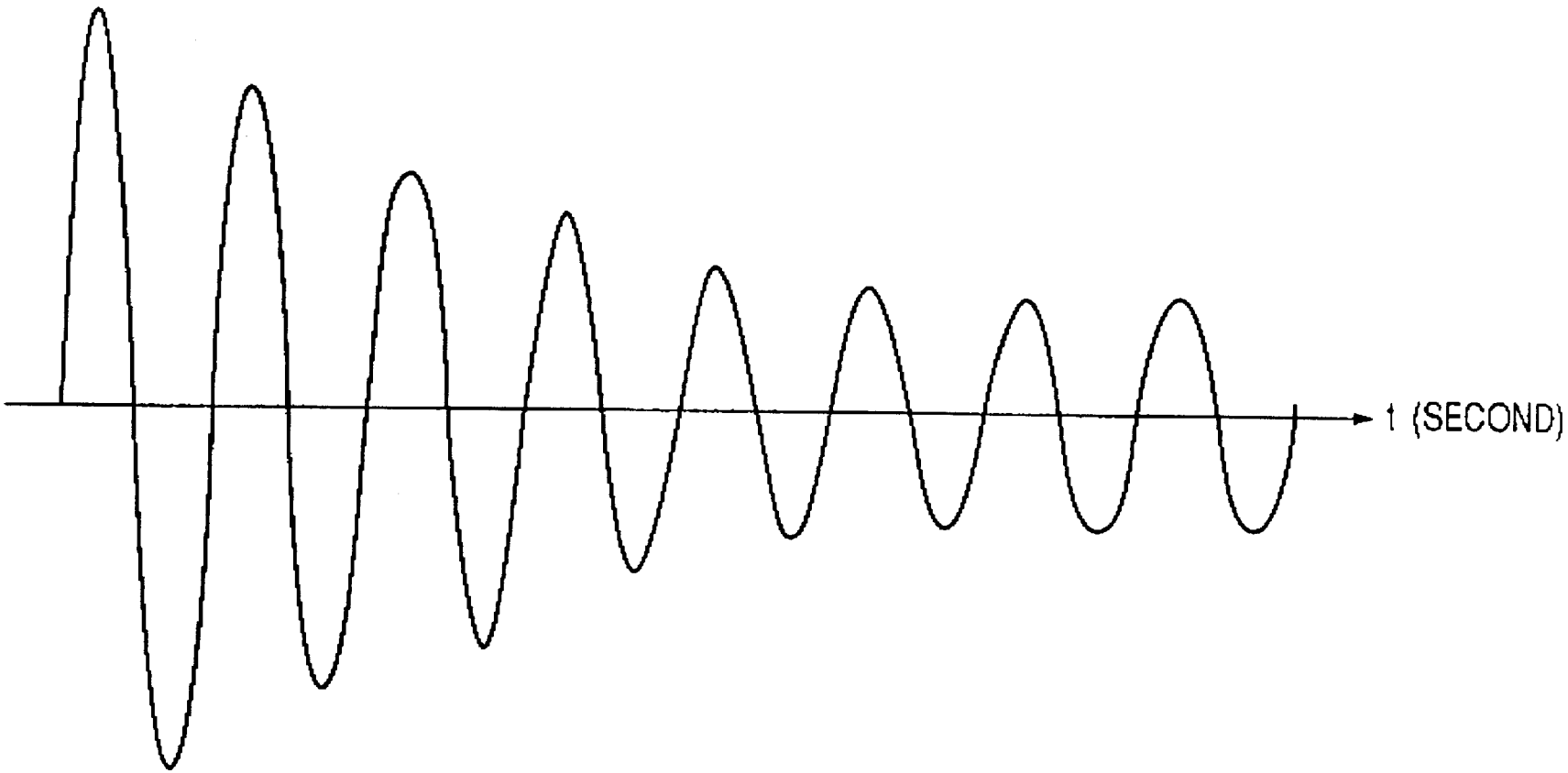
FIG. 3 is a diagram showing a waveform of rush current flowing through heaters of the fixing apparatus.

FIG. 3 is a diagram showing a waveform of rush current flowing through the sub-heater 13 at this time, and the current first flows about twice to 2.5 times as much as the steady current. To relax or moderate this phenomenon, in the present invention, the main heater 12 and the sub-heater 13 are controlled as follows.

During continuous image formation (continuous copy mode), the main heater 12 continues to be driven. When the continuous image forming operation is performed, the amount of heat taken by the transfer material P from the fixing roller 10 increases and, therefore, the temperature of the fixing roller 10 gradually lowers.

Figure 4:
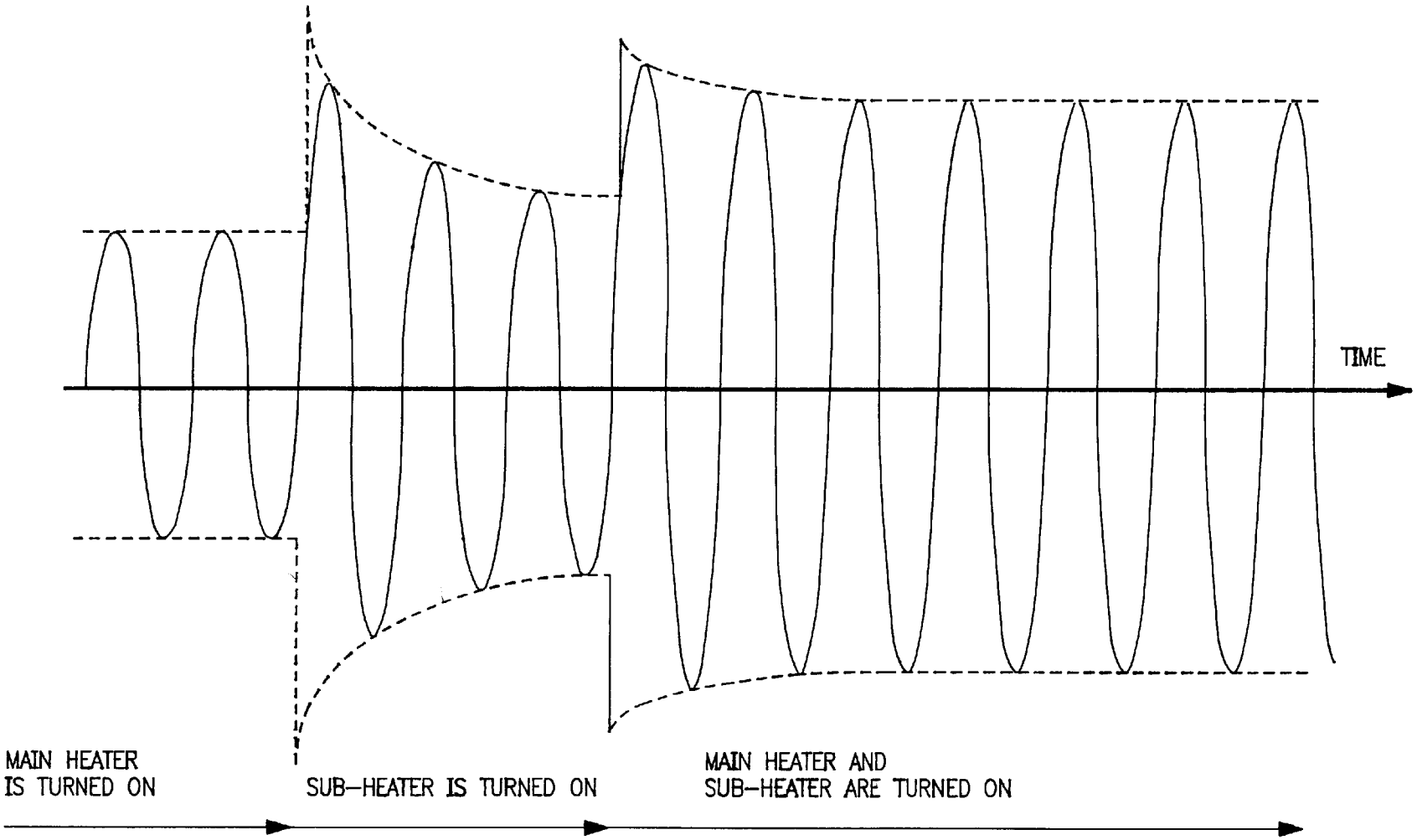
FIG. 4 is a diagram showing the envelope of an AC peak current flowing through the heaters of the fixing apparatus in the present embodiment.

In this case, as shown in FIG. 4, while the main heater 12 is energized, but the sub-heater 13 is turned off for a predetermined time, the control portion 19 performs the following power supply control when restarting the power supply to the sub-heater 13 (predetermined time A in FIG. 4).

Specifically, after the zero cross detecting portion 14 detects the zero cross of the alternating-current power source 15, the main heater driving portion 16 and the sub-heater driving portion 17 are controlled so that the sub-heater 13 is energized with a transmission wave and simultaneously the power supply to the main heater 12 is stopped for the predetermined time A (about one to two seconds). Subsequently, the main heater driving portion 16 is driven to energize the main heater 12 again. Then, the current to form the envelope of the AC peak current shown in FIG. 4 flows through each of the main heater 12 and the sub-heater 13.

Figure 5:
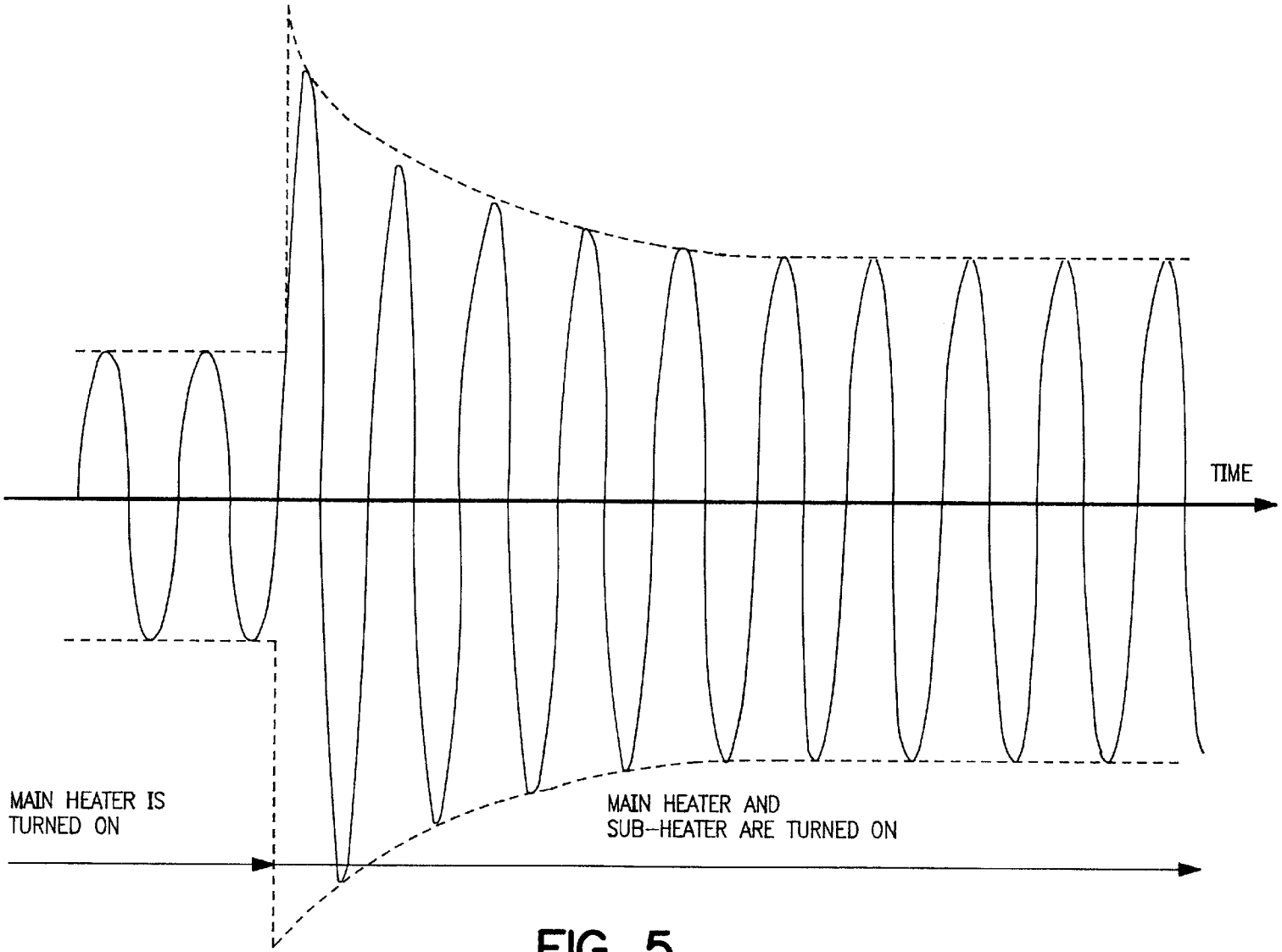
FIG. 5 PRIOR ART
FIG. 5 is a diagram showing the envelope of the AC peak current flowing through the heaters of the fixing apparatus in a conventional example.

On the other hand, in the conventional power supply control, the current to form the envelope of the peak AC current shown in FIG. 5 flows through each of the main heater 12 and the sub-heater 13. In the conventional power supply control shown in FIG. 5, while the main heater 12 is energized, the power supply to the sub-heater 13 starts. Therefore, the rush current during the drive of the sub-heater 13 is added to the steady current of the main heater 12 as it is, the change amount of the current increases, and the voltage drop of the alternating-current power source 15 increases. Furthermore, the flicker noise value increases.

As described above, by performing the power supply control of the present invention as shown in FIG. 4, a difference between the current value of the main heater 12 and the rush current value of the sub-heater 13 is reduced as compared with the conventional power supply control shown in FIG. 5. Therefore, the voltage drop of the alternating-current power source 15 is reduced, and the flicker noise value can be lowered.

Moreover, while the sub-heater 13 is energized for the predetermined time A, the sub-heater 13 is also warmed. Therefore, by energizing the main heater 12 before the current value is stabilized, the current difference is reduced as a result, and the flicker value can be reduced.

Figure 6:
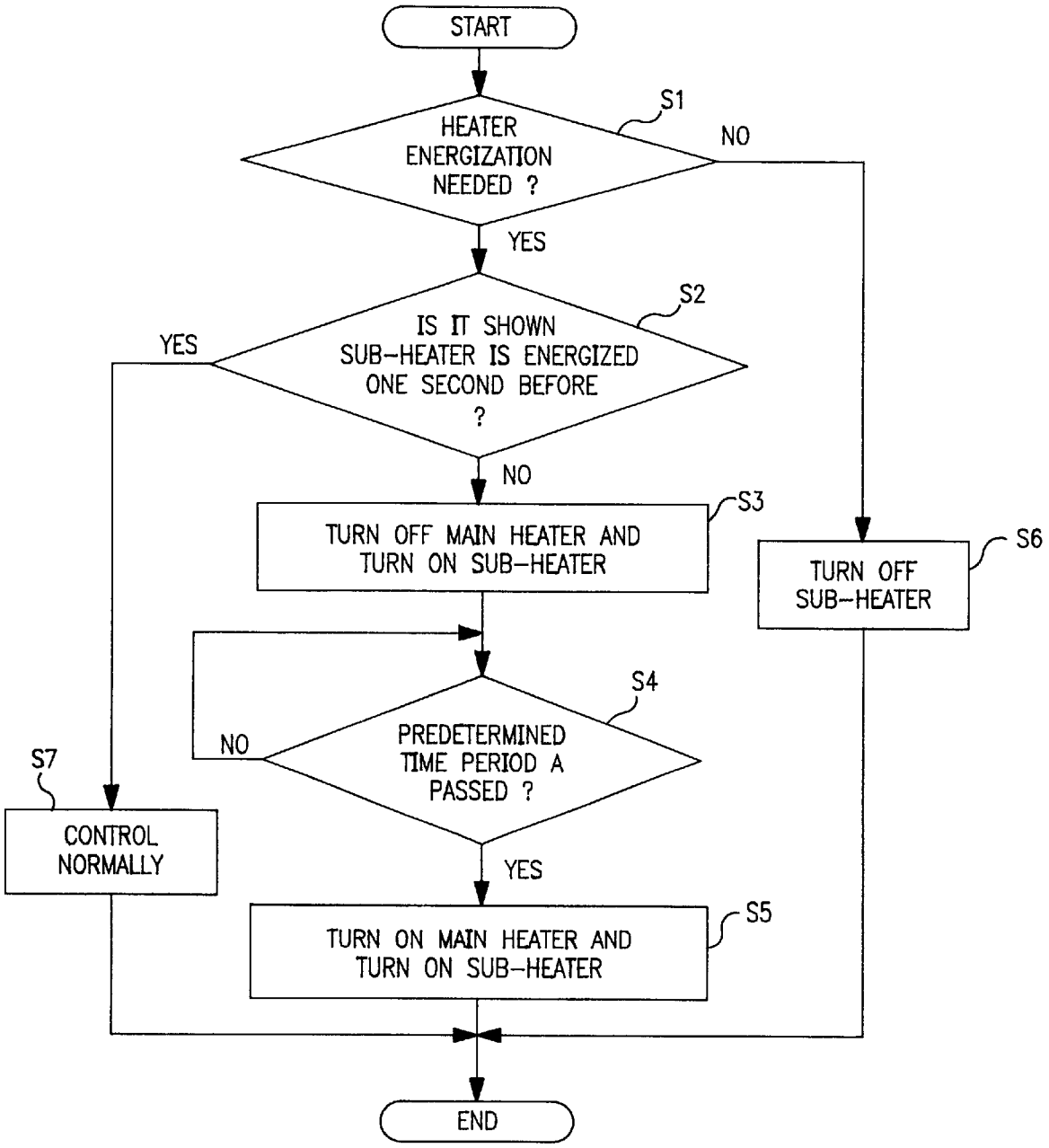
FIG. 6 is a flowchart showing a power supply control to the fixing apparatus heater in the present embodiment.

The above-described power supply control by the control portion 19 of the present invention will next be described with reference to the flowchart of FIG. 6.

First, at step Si the control portion 19 inputs the surface temperature information of the fixing roller 10 from the thermistor 18 during the continuous image formation, and judges based on the inputted surface temperature information of the fixing roller 10 whether the sub-heater 13 needs to be energized during the energizing of the main heater 12. When it is judged at step S1 that the sub-heater 13 needs to be energized, it is judged whether the sub-heater 13 was energized a predetermined time B before (one second before in the present embodiment) (step S2).

At the step S2, when the sub-heater 13 was not energized one second before, the energized main heater 12 is turned off, and the sub-heater 13 is fully energized at the zero cross (step S3). Additionally, when it is judged in the step S2 whether or not the sub-heater 13 was energized one second before, time is measured by the timer potion 20 of FIG. 2.

Subsequently, when it is determined from the state of the step S3 that the predetermined time A has elapsed according to the measurement of the timer portion 20 (step S4), the main heater 12 is turned on (step S5), and the main heater 12 and the sub-heater 13 are fully energized at the zero cross.

Moreover, when it is judged in the step S1 that the sub-heater 13 does not need Lo be energized, the sub-heater 13 is turned off (step S6). Furthermore, when the sub-heater 13 was energized one second before in the step S2, the sub-heater 13 is constantly fully energized and normally controlled without turning off the main heater 12 (step S7).

Additionally, the reason why it is checked at the step S2 whether the sub-heater 13 was energized the predetermined time B (one second) before is that when the sub-heater 13 is again energized and much time has not elapsed, the rush current is small. Therefore, even when the control operations of the steps S3 and S4 are not performed, the flicker noise value is reduced.

The present invention is not limited to the above-described embodiment, and includes modifications of the same technical scope.

What is claimed is:

1. An image heating apparatus comprising:

a first heater;

a second heater; and power supply control means for controlling an electrical power supplied to said first and second heaters, wherein, when the electrical power supply to said second heater is started during the electrical power supply to said first heater, said power supply control means controls the electrical power supply to said first heater in accordance with a heating condition of said second heater.

2. An image heating apparatus according to claim 1, wherein, when the electrical power supply to said second heater is started during the electrical power supply to said first heater, said power supply control means controls the electrical power supply to said first heater in accordance with a state of the electrical power supply to said second heater a predetermined time before.

3. An image heating apparatus according to claim 2, wherein, when the electrical power supply to said second heater is started during the electrical power supply to said first heater, said power supply control means controls the electrical power supply to said first heater depending on whether or not the electrical power supply to said second heater was performed the predetermined time before.

4. An image heating apparatus according to claim 3, wherein, when the electrical power supply to said second heater is not performed the predetermined time before, said power supply control means temporarily discontinues the electrical power supply to said first heater and simultaneously starts the electrical power supply to said second heater, and subsequently restarts the electrical power supply to said first heater.

5. An image heating apparatus according to claim 4, wherein, when the electrical power supply to said second heater is performed the predetermined time before, said power supply control means starts the electrical power supply to said second heater without discontinuing the electrical power supply to said first heater.

6. An image heating apparatus according to claim 1, further comprising a heating roller to be heated by said first and second heaters, and a temperature detecting element for detecting a temperature of said heating roller, wherein said power supply control means controls the electrical power supplied to said first and second heaters so that the temperature detected by said temperature detecting element is maintained at a set temperature.

7. An image heating apparatus, comprising:

a first heater;

a second heater; and power supply control means for controlling an electrical power supplied to the first and second heaters, wherein, when the electrical power supply to said second heater is started during the electrical power supply to said first heater, said power supply control means temporarily discontinues the electrical power supply to said first heater and simultaneously starts the electrical power supply to said second heater, and subsequently restarts the electrical power supply to said first heater.

8. An image heating apparatus according to claim 7, wherein said power supply control means temporarily discontinues the electrical power supply to said first heater and simultaneously starts the electrical power supply to said second heater, and restarts the electrical power supply to said first heater after a predetermined time.

9. An image heating apparatus according to claim 7, further comprising a heating roller to be heated by said first and second heaters, and a temperature detecting element for detecting a temperature of said heating roller, wherein said power supply control means controls the electrical power supplied to said first and second heaters so that the temperature detected by said temperature detecting element is maintained at a set temperature.

* * * * *

UNITED STATES PATENT AND TRADEMARK OFFICE

CERTIFICATE OF CORRECTION

PATENT NO. : 6,243,547 B1
DATED : June 5, 2001
INVENTOR(S) : Yoshio Mizuno et al.

It is certified that error appears in the above-identified patent and that said Letters Patent is hereby corrected as shown below:

Column 6,
Line 2, "Lo" should read -- to --.

Signed and Sealed this

Fifteenth Day of January, 2002

*Attest:*

*Attesting Officer*

JAMES E. ROGAN
*Director of the United States Patent and Trademark Office*